US011332967B2

(12) United States Patent
Siriwardana

(10) Patent No.: US 11,332,967 B2
(45) Date of Patent: May 17, 2022

(54) HANGING DOOR STOP

(71) Applicant: Pulathis Nilantha Siriwardana, Stanmore (GB)

(72) Inventor: Pulathis Nilantha Siriwardana, Stanmore (GB)

( * ) Notice: Subject to any disclaimer, the term of this patent is extended or adjusted under 35 U.S.C. 154(b) by 0 days.

(21) Appl. No.: 17/050,496

(22) PCT Filed: Apr. 17, 2019

(86) PCT No.: PCT/GB2019/000059
§ 371 (c)(1),
(2) Date: Oct. 26, 2020

(87) PCT Pub. No.: WO2019/207271
PCT Pub. Date: Oct. 31, 2019

(65) Prior Publication Data

US 2021/0189783 A1 Jun. 24, 2021

(30) Foreign Application Priority Data

Apr. 27, 2018 (GB) ..... 1806956

(51) Int. Cl.
*E05F 5/02* (2006.01)
*E05F 5/04* (2006.01)

(52) U.S. Cl.
CPC ..... *E05F 5/04* (2013.01); *E05F 2005/046* (2013.01); *E05Y 2900/132* (2013.01)

(58) Field of Classification Search
CPC ..... E05C 17/00; E05C 17/46; E05C 17/54; E05C 17/44; E05C 17/025; E05F 5/02;
(Continued)

(56) References Cited

U.S. PATENT DOCUMENTS 485,613 A * 11/1892 Deane ..... E05D 11/1007 16/353
896,242 A * 8/1908 Ralston ..... E05F 5/04 16/83

(Continued)

FOREIGN PATENT DOCUMENTS

JP S57120660 U 7/1982

*Primary Examiner* — Chuck Y Mah
(74) *Attorney, Agent, or Firm* — Iandiorio Teska & Coleman, LLP

(57) ABSTRACT

A door stop (2) which comprises: (i) a hanger part (4); and (ii) a door stop part (6) which in use hangs from the hanger part (4), the door stop part (6) being such that is comprises: (iii) a first door stop formation (8) for being positioned at a hinge side (10) of a door (12), and in a gap (14) between the door (12) and a door frame (16) for the door (12); and (iv) a second door stop formation (18) for being positioned at the hinge side (10) of the door (12), and in the gap (14) between the door (12) and the door frame (16) for the door (12), and wherein: (v) the first door stop formation (8) is below the second door stop formation (18) when the door stop part (6) hangs from the hanger part (4); (vi) the first door stop formation (8) is of a first door-stopping size which stops the door (12) in a first open position at a first open angle; (vii) the second door stop formation (18) is of a second door-stopping size which stops the door (12) in a second open position at a second open angle; (viii) the first open angle is larger than the second open angle; (ix) the first open position is for use by an adult; (x) the second open position is for use by a child; (xi) the first open position is such as to cause the gap to be of a first size; (xii) the second open position is such as to cause the gap to be of a second size; and (xiii) the gap of the first size and the gap of the second size are both such that the child cannot get their fingers trapped firstly between the door (12) and the door frame (16) at the hinge side (10)
(Continued)

of the door (12), and secondly between the door (12) and the door frame (16) at a handle side of the door (12).

19 Claims, 6 Drawing Sheets

(58) Field of Classification Search
CPC ..... E05F 5/04; E05F 5/06; E05F 5/00; E05F 2005/046; E05Y 2900/132; E05Y 2201/212; E05Y 2201/224; Y10T 292/71; Y10T 292/73
See application file for complete search history.

(56) References Cited

U.S. PATENT DOCUMENTS 1,037,641 A * 9/1912 Koch, Jr. ..... E05F 5/04 16/83
1,117,253 A * 11/1914 Sargent ..... E05F 5/04 16/83
1,354,079 A * 9/1920 Tate ..... E05F 5/02 16/83
1,360,008 A * 11/1920 Naslin ..... E05F 5/04 16/83
1,510,873 A * 10/1924 Tate ..... E05F 5/02 16/83
1,605,422 A * 11/1926 Benedict ..... E05B 65/0894 292/343
1,649,339 A * 11/1927 Conley ..... E05F 5/02 16/83
1,944,101 A * 1/1934 Meier ..... E05F 5/06 16/86 A
2,175,403 A 10/1939 Larson
3,137,025 A 6/1964 Howard
3,200,434 A * 8/1965 Jarnot ..... E05F 5/04 16/86 A
3,800,360 A 4/1974 Knarreborg
4,028,772 A 6/1977 Salerno
5,027,471 A * 7/1991 Barnes ..... E05F 5/06 16/86 R
5,369,840 A * 12/1994 Salvador ..... E05C 17/54 16/82
5,680,675 A * 10/1997 Davis ..... E05C 17/025 16/83
6,003,911 A * 12/1999 Sowash ..... E05C 17/025 16/82
6,557,915 B1 * 5/2003 Duff ..... E05C 17/54 292/343
6,616,128 B2 * 9/2003 Selzer ..... A62B 3/005 254/104
7,014,229 B1 * 3/2006 Stelmach ..... E05C 17/44 292/342
7,506,905 B1 * 3/2009 George ..... E05C 17/025 16/82
7,786,884 B1 * 8/2010 McRoskey ..... E06B 7/36 340/686.1
7,976,080 B1 * 7/2011 Duff ..... E05C 17/54 292/343
8,678,453 B2 * 3/2014 Caliguri ..... E05C 17/025 292/288
8,955,891 B2 * 2/2015 Millsap ..... E05C 17/025 292/288
9,347,251 B1 * 5/2016 Lewis ..... B60J 5/00
10,113,350 B2 * 10/2018 Brown ..... E05F 5/06
10,833,297 B2 * 11/2020 Ahn ..... H01M 10/0481
2006/0162255 A1 * 7/2006 Lee ..... E06B 7/36 49/383
2006/0208920 A1 * 9/2006 Carrella ..... E05B 17/10 340/686.1
2007/0126248 A1 * 6/2007 Mintz ..... E05C 17/025 292/342
2008/0079270 A1 4/2008 Carlson
2008/0277949 A1 * 11/2008 Emde ..... E05C 17/025 292/343
2009/0260182 A1 * 10/2009 Hall ..... E05C 17/025 16/82
2010/0242226 A1 * 9/2010 Hopkins ..... E05C 17/54 16/82
2010/0289280 A1 * 11/2010 Nadrowski ..... E05C 17/54 292/343
2011/0254293 A1 * 10/2011 Duff ..... E05C 17/025 292/343
2012/0060421 A1 * 3/2012 Wong ..... E06B 7/36 49/383
2020/0300009 A1 * 9/2020 Miller ..... E05C 17/025

* cited by examiner

HANGING DOOR STOP

This invention relates to a door stop and, more especially, this invention relates to a hanging door stop.

Door stops are traditionally wedge shaped and they slide underneath a door in order to wedge the door open. Often doors are wedged open by parents in order to try and stop the possibility of young children getting their fingers trapped between the door and a door frame for the door. The door stops which slide under the door are not satisfactory in that they may not easily slide under the door, for example when they are required to slide on carpet. Also, it is often necessary for a person to bend down to insert the door stop in position and/or remove the door stop. This may be inconvenient. Furthermore, if the door stop is removed, it may be that an adult will forget to replace the door stop at a time when a child is in the vicinity of the door, and there then occurs the possibility that the child may get their fingers trapped between the door and the door frame. The trapping of the fingers of the child may occur firstly between the door and the door frame at a hinge side of the door, and secondly between the door and the door frame at a handle side of the door. Still further, the door stop is accessible to a child, and thus the child may remove the door stop and thereby expose themselves to the danger of getting their fingers trapped.

Hanging door stops are known which overcome the above mentioned problems associated with floor-sliding door stops. The hanging door stops hang from a top portion of the door and they thus do not require an adult to bend for positioning and removal, and they are out of reach of children. Furthermore, the hanging door stops are able to be left in position and operate substantially automatically, thereby overcoming the problem associated with known floor-operating door stops where they may be removed for some reason and then forgotten to be replaced.

The known floor-sliding door stops and the known hanging door stops operate such that they maintain the door in a single open position. This single open position of the door may be such that it is too wide for easy use by a child and/or too narrow for easy use by an adult.

It is an aim of the present invention to prevent or reduce the above mentioned problem.

Accordingly, the present invention provides a door stop which comprises:

(i) a hanger part; and (ii) a door stop part which in use hangs from the hanger part, the door stop part being such that it comprises:

(iii) a first door stop formation for being positioned at a hinge side of a door, and in a gap between the door and a door frame for the door; and (iv) a second door stop formation for being positioned at the hinge side of the door, and in the gap between the door and the door frame for the door, and wherein:

(v) the first door stop formation is below the second door stop formation when the door stop part hangs from the hanger part;

(vi) the first door stop formation is of a first door-stopping size which stops the door in a first open position at a first open angle;

(vii) the second door stop formation is of a second door-stopping size which stops the door in a second open position at a second open angle;

(viii) the first open angle is larger than the second open angle;

(ix) the first open position is for use by an adult;

(x) the second open position is for use by a child;

(xi) the first open position is such as to cause the gap to be of a first size;

(xii) the second open position is such as to cause the gap to be of a second size; and (xiii) the gap of the first size and the gap of the second size are both such that the child cannot get their fingers trapped firstly between the door and the door frame at the hinge side of the door, and secondly between the door and the door frame at a handle side of the door;

(xiv) the first door stop formation is axially in line with the second door stop formation such that the door stop part has a single straight longitudinal axis;

(xv) the hanger part is such that it comprises a length of flexible material by which the first door stop formation or the second door stop formation are able to be positioned at the hinge side of the door and in the gap between the door and the door frame to give the required first open position or the second open position; and (xvi) the length of flexible material is symmetrically connected to the second door stop formation such that the door stop part is able to hang freely from the length of flexible material with the single straight longitudinal axis of the door stop part being in line with the length of flexible material.

The door stop of the present invention is thus advantageous in that it is able to provide the known advantage of known hanging door stops in that the door stop is able to operate substantially automatically, with an adult being able to fix the door stop and then being able to forget about the door stop and not have to keep worrying about removing and replacing the door stop as often occurs with known floor-sliding door stops. The door stop of the present invention is also out of reach of the child and thus it cannot be removed by the child. Still further, the door stop of the present invention is able to provide the first open position for use by an adult, and the second open position for use by a child. The first open position may be chosen for ease of use by the adult, and the second open position may be chosen for ease of use by the child. In both open positions, the child cannot get their fingers trapped firstly between the door and the door frame at the hinge side of the door, and secondly between the door and the door frame at the handle side of the door.

The door stop may be one in which the second door stop formation is longer than the first door stop formation. The second door stop formation may be a rod. Other constructions for the second door stop formation may be employed. The second door stop formation may be cylindrical in cross section. Other cross sectional shapes may be employed for the second door stop formation. Thus, for example, the second door stop formation may be of a cross shape in cross section.

The door stop may be one in which the first door stop formation is a knob. Other constructions for the first door stop formation may be employed The door stop may be one in which the first door stop formation has a curved outer face. Alternatively, the first door stop formation may have planar faces.

The door stop may be one in which the first door stop formation tapers outwardly in a direction away from the second door stop formation. This tapering may give a progressive resistance to the door, thereby reducing the possibility of damaging the door and/or the door frame. Alternatively, the first door stop formation may taper in the opposite direction, or it may be parallel sided.

The door stop may be one in which the first door stop formation is a one-piece first door stop formation.

Alternatively, the door stop may be one in which the first door stop formation is a two-piece first door stop formation, and in which the two-piece first door stop formation comprises an outer piece which fits over an inner piece. The two-piece first door stop formation may be used for providing the option of enabling the door stop to be used with fire doors or with non-fire doors. Fire doors are typically thicker than non-fire doors. For example a fire door may typically be 4.5 cm thick, whilst a non-fire door may be 3.5 mm thick. If the first door stop formation is produced for the fire door, then it may not fit with maximum efficiency for a non-fire door because the gap at the hinge side of the door in the non-fire door will typically be narrower than the gap in a fire door.

Preferably, the outer piece is a sliding fit over the inner piece. Other connecting constructions may be employed so that, for example, the outer and inner pieces may connect together by a screw connection or a bayonet connection.

The door stop may be one in which the first door stop formation has a friction-increasing outer surface. The friction-increasing outer surface is preferably a plurality of longitudinally extending splines. Other types of friction-increasing outer surface configurations may be employed, including for example protuberances such for example as pips.

Where the friction-increasing outer surface is formed by the plurality of longitudinally extending splines, the splines may have peaks, and the peaks may be non-pointed peaks. Typically, peaks come to a point but the points of such peaks tend to reduce the surface area by which the splines contact the door and the door frame. By producing the splines to have the non-pointed flat portions, the surface area with which the peaks contact the door and the door frame is able to be increased.

When the first door stop formation is a two-piece first door stop formation, then the first door stop formation is preferably such that both the outer piece and the inner piece have the friction-engaging outer surface. The friction may be provided by a micro-roughness of the outer surface and/or the use of a non-slip material.

The door stop may be one in which the second door stop formation includes a finger-gripping recess, and in which the finger-gripping recess prevents the adult getting their fingers trapped between the second door stop formation and the door and/or the door frame. The recess may be of any suitable length for receiving the fingers of the adult. The recess may be positioned where desired along the second door stop formation, for example near to the first door stop formation.

The second door stop formation may have an end which is remote from the first door stop formation and which is curved. Such a curved end may facilitate the insertion of the second door stop formation in the gap when the door is opened to give the gap of the second size. The curved end may be formed by a separate cap. Alternatively the curved end may be an integral part of the second door stop formation.

The length of flexible material is preferably a length of cord. Lengths of other flexible material may be employed so that, for example, the length of flexible material may be a chain or a thin cable.

The door stop may be one in which the hanger part is separate from the door stop part, and in which the hanger part is connected to the door stop by connecting means. The connecting means may be any suitable connecting formation such for example as a ring or a hook. In an alternative embodiment of the invention, the hanger part may be integrally formed with the door stop part. In this case, the integral formation may be effected by moulding the hanger part with the door stop part.

The door stop may include fastener means for fastening the door stop at an elevated position above a bottom part of the door.

Preferably, the fastener means is a removable fastener means. The removable fastener means may comprise a hook formation for removably hooking over an upper hinge connecting the door to the door frame. Other types of removable fastener means may be employed so that, for example, the removable fastener means may be a formation such as a ring for receiving a screw holding the hinge in place. Alternatively, the removable fastener means may be a simple tie. If desired, the fastener means may be a non-removable fastener means such for example as a nail or a screw which is nailed or screwed into the door or the door frame.

When the removable fastener means is a hook formation, then the hook formation may have a friction gripping portion, and an attachment portion for attaching to the hanger part. The friction gripping portion may be a spring friction gripping portion. Any suitable means may be employed to provide the required friction. Irrespective of whether or not the fastener means is removable or non-removable, the fastener means will typically be such that it does not interfere with the operation of a hinge on the door, or the operation of the door itself.

The door stop may be one in which the first door-stopping size stops the door in the first open position such that the first open angle is from 60-80°. Preferably the first open angle is 70°. Other first open angles may be employed.

The door stop may be one in which the second door-stopping size stops the door in the second open position such that the second open angle is from 20-30°. Preferably the second open angle is 25°. Other second open angles may be employed.

The door stop may be one in which the door stop part is of a length which is approximately half the total length of the door stop. The door stop part may be 24 cm long. Other lengths for the door stop part may be employed.

The door stop may be one in which its total length is 50-55 cm long.

When the second door stop formation has an end which is remote from the first door stop formation, and when this end is curved, then the end may be a part-circular end having a diameter of 1.2 cm. Other diameters may be employed.

Preferably, the door stop is constructed and/or made of a material does not damage the door, the door frame or the hinge. The chosen material for the door stop may be compressible, but not so soft that it is not sufficiently robust in use. The door stop may be made of a single material having an appropriate Shore Hardness. Preferably the Shore Hardness is in the range of 60 A-95 A. Materials of other Shore Hardnesses may be employed.

If desired, the door stop may be made of two materials such that it has a hard core and an outer softer covering. Such a door stop may be made by dual moulding or twin shot plastics materials. The core may be made of polypropylene and the covering may be made of thermoplastic elastomer (TPE).

The door stop of the present invention may comprise a pressure sensor for causing an audio and/or visual alarm when closure of the door is attempted when the door stop is in use. The pressure sensor is preferably provided on the door stop part of the door stop, but it may be provided elsewhere on the door stop if desired. The door stop may comprise the pressure sensor and a signal generator for providing a signal when a predetermined applied pressure is detected. The signal generator may generate an electronic signal which causes the audio and/or visual alarm. The electronic signal may be a Wi-Fi or any other suitable signal.

The door stop of the present invention may also comprise a smoke detector and/or a fire detector for providing an audio and/or visual alarm in the event of a fire. The smoke detector and the fire detector are preferably provided on the door stop part of the door stop, but they may be provided elsewhere on the door stop if desired.

Embodiments of the invention will now be described solely by way of example and with reference to the accompanying drawings in which.

Figure 1:
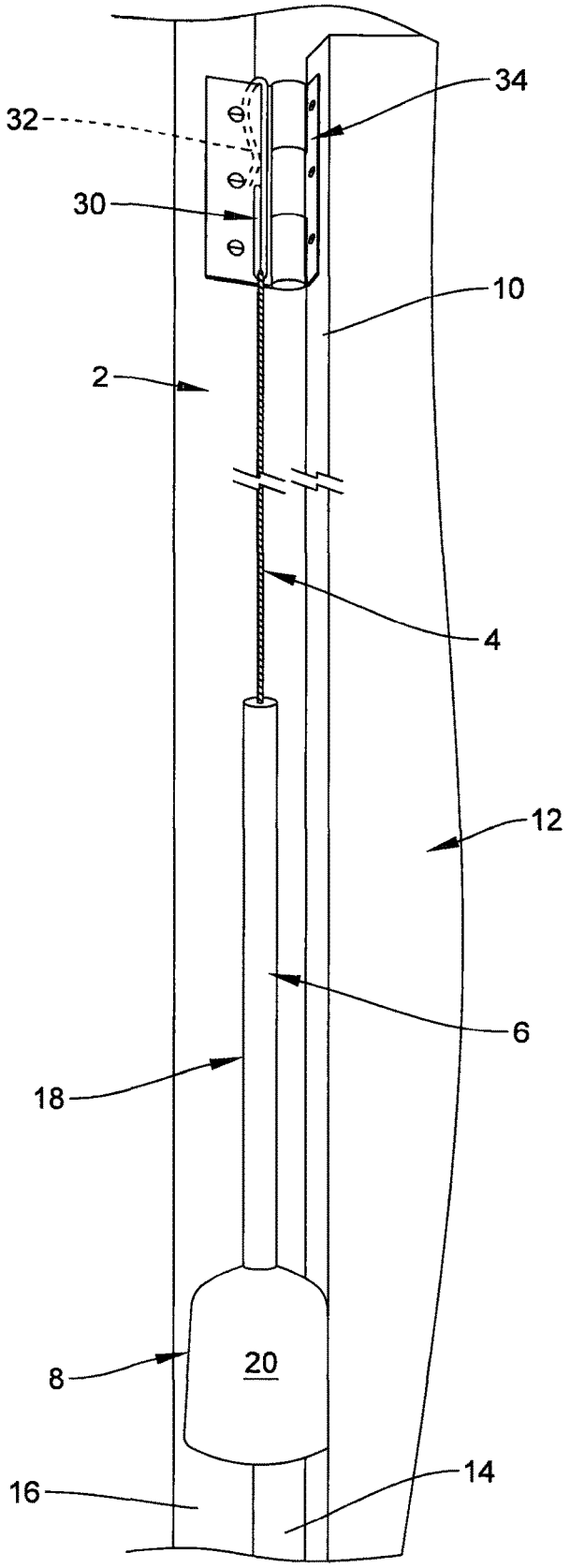
FIG. 1 shows a first door stop of the present invention in use on a door, and with the door being in a first open position at a first open angle.

Referring to FIGS. 1-9, there is shown a door stop 2 which comprises a hanger part 4 and a door stop part 6 which in use hangs from the hanger part 4.

The door stop part 6 is such that it comprises a first door stop formation 8 for being positioned at a hinge side 10 of a door 12, and in a gap 14 between the door 12 and a door frame 16 for the door 12.

The door stop part 6 also comprises a second door stop formation 18 for being positioned at the hinge side 10 of the door 12, and in the gap 14 between the door 12 and the door frame 16 for the door 12.

The first door stop formation 8 is below the second door stop formation 18 when the door stop part 6 hangs from the hanger part 4.

Figure 4:
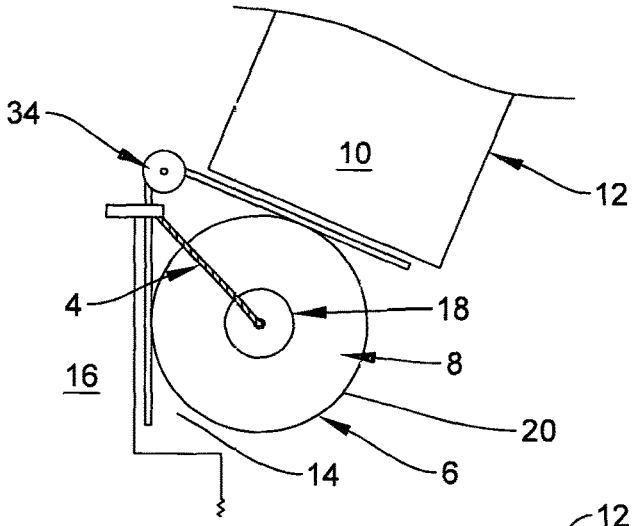
FIG. 4 is a top plan view of the door stop and the door in the position shown in FIG. 1.

The first door stop formation 8 is of a first door-stopping size which stops the door 12 in a first open position at a first open angle. This first open position is shown in FIGS. 1 and 4.

Figure 2:
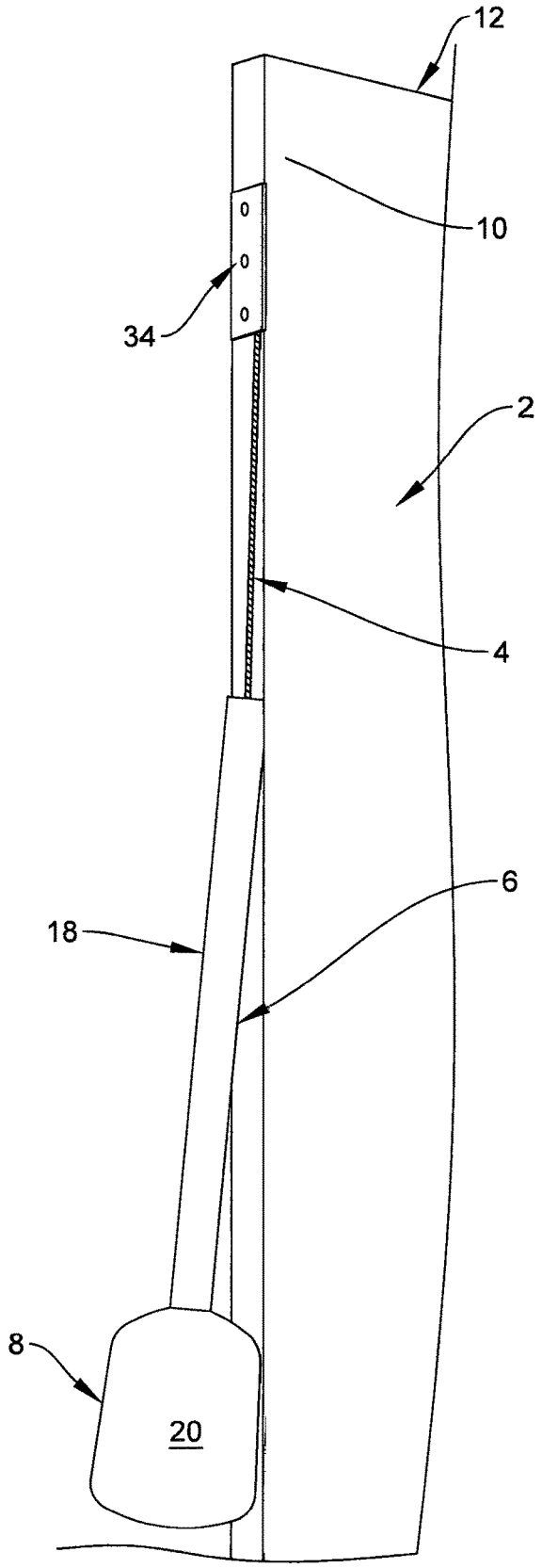
FIG. 2 is a view like FIG. 1 but shows the door in a second open position at a second open angle.
Figure 5:
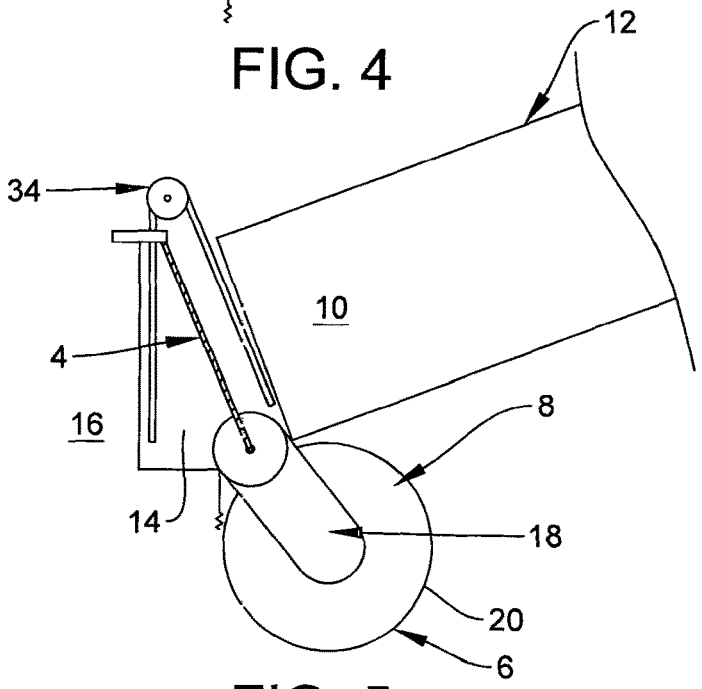
FIG. 5 is a top plan view of the door stop and the door in the position shown in FIG. 2.

The second door stop formation 18 is of a second door-stopping size which stops the door 12 in a second open position at a second open angle. This second open position is shown in FIGS. 2 and 5.

The first open angle is larger than the second open angle. The first open position is for use by an adult. The second open position is for use by a child. The first open position is not restricted to being for use by a adult and it may be used by, for example, a child or a household pet. Similarly, the second position is not restricted to being for use by a child and it may be used by, for example, an adult or a household pet.

The first open position is such as to cause the gap to be of a first size. The second open position is such as to cause the gap to be of a second size. The gap of the first size and the gap of the second size are both such that the child cannot get their fingers trapped firstly between the door 12 and the door frame 16 at the hinge side 10 of the door 12, and secondly between the door 12 and the door frame 16 at a handle side of the door 12.

Figure 3:
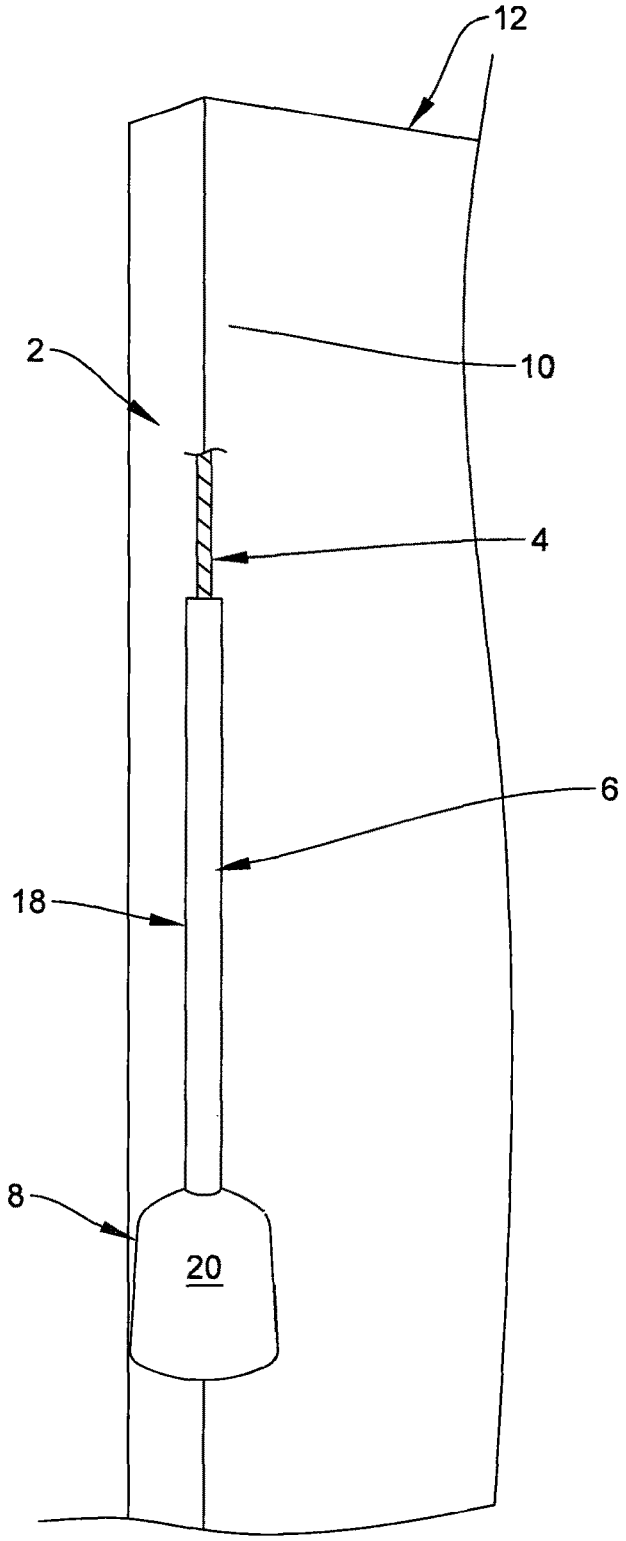
FIG. 3 is a view like FIG. 1 but shows the door in a closed position.
Figure 6:
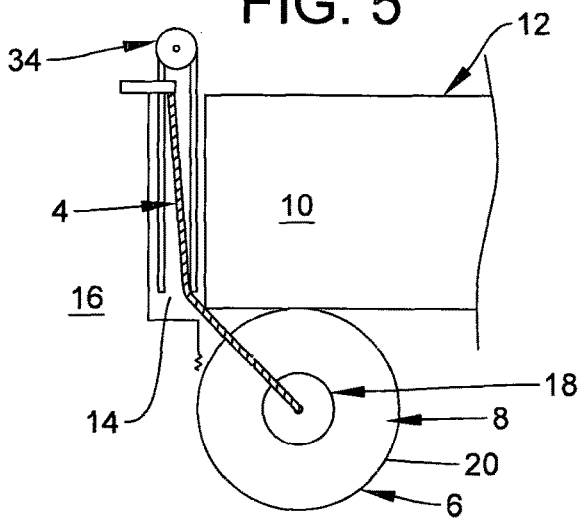
FIG. 6 is a top plan view of the door stop and the door in the position shown in FIG. 3.

FIGS. 3 and 6 show the position of the door stop 2 when the door 12 is in a closed position. It will be seen that the first door stop formation 8 and the second door stop formation 18 are not in the gap 14. Only the hanger part 4 is in the gap 14.

Figure 7:
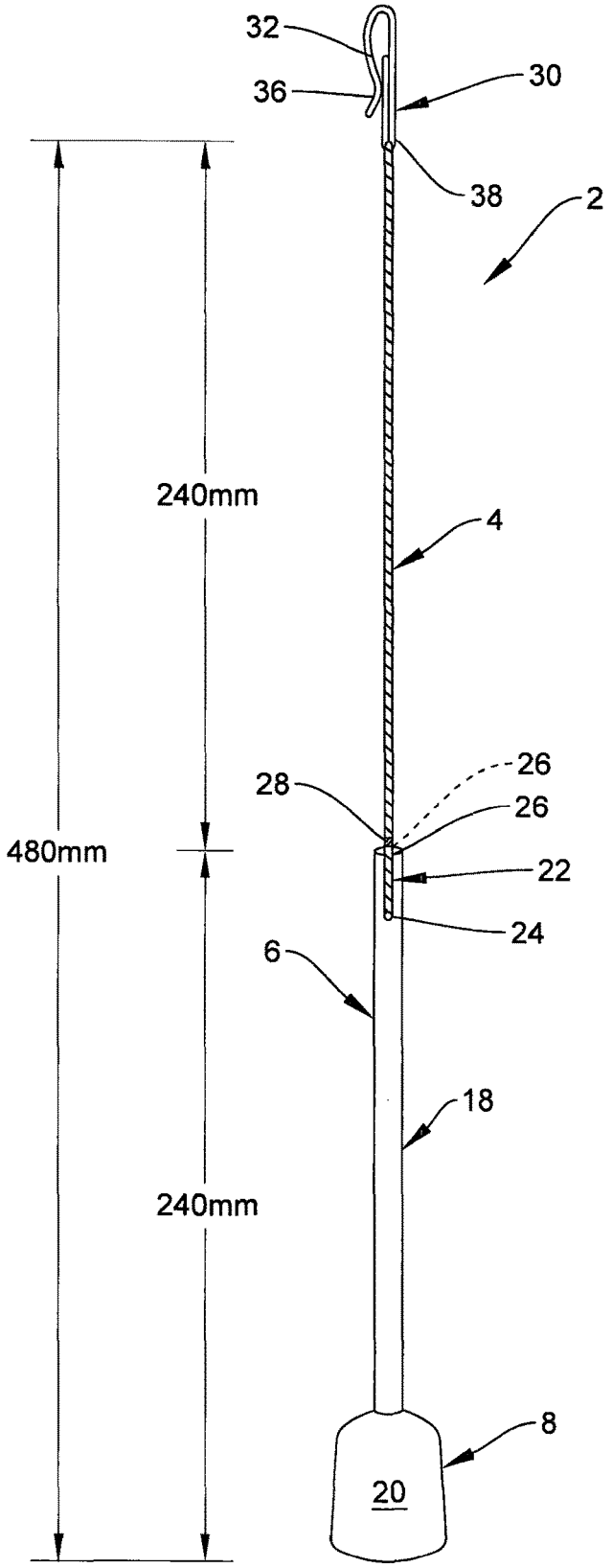
FIG. 7 shows the door stop shown in FIGS. 1-6.

As shown in FIG. 7, the door stop 2 is such that the second door stop formation 18 is longer than the first door stop formation 8. The second door formation 18 is in the form of a rod. The second door formation 18 is cylindrical in cross section.

The first door stop formation 8 is in the form of a knob. The first door stop formation 8 has a curved outer face 20.

The first door stop formation 8 tapers outwardly in a direction away from the second door stop formation 18. The first door stop formation 8 is a one-piece first door stop formation 8.

The first door stop formation 8 preferably has a friction-increasing outer surface. The friction-outer surface is preferably a plurality of longitudinally extending splines. The splines are preferably such that they have peaks, and the peaks are non-pointed peaks. The non-pointed peaks increase the surface area with which the first door stop formation 8 is able to operate.

The hanger part 4 is a length of flexible material. The length of flexible material is a length of cord. The first door stop formation 8 is axially in line with the second door stop formation 18 such that the door stop part 6 has a single straight longitudinal axis. The length of flexible material is symmetrically connected to the second door stop formation 18 such that the door stop part 6 is able to hang freely from the length of flexible material with the single straight longitudinal axis of the door stop part 6 being in line with the length of flexible material.

Figure 9:
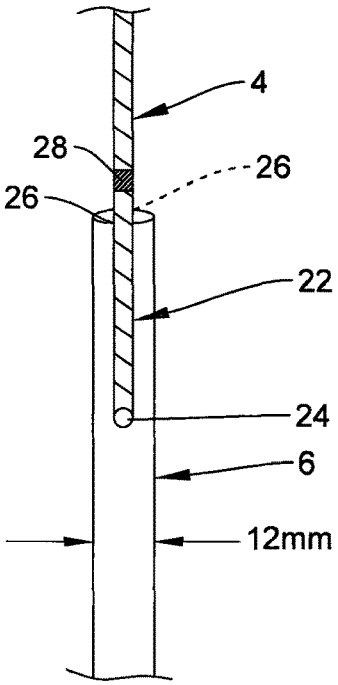
FIG. 9 is an enlarged view of a middle part of the door stop as shown in FIG. 7.

As best appreciated from FIGS. 7 and 9, the hanger part 4 is separate from the door stop part 6. The hanger part 4 is connected to the door stop part 6 by connecting means 22. The connecting means 22 comprises a bore 24 which extends transversely through the second door stop formation 18, and a pair of longitudinally extending grooves 26 which extend one on either side of the second door stop formation 18 upwardly from the bore 24 to the end of the second door stop formation 18. One end of the hanger part 4 extends along one of the grooves 26, through the bore 24, and up the other groove 26 where it is then tied to itself by a knot 28.

Figure 8:
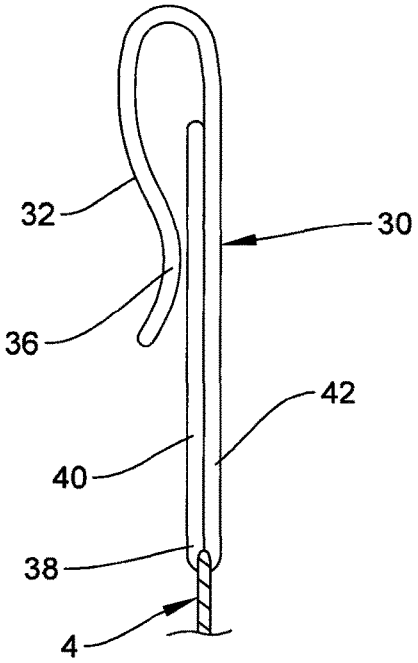
FIG. 8 is an enlarged view of a top part of the door stop as shown in FIG. 7.

The door stop 2 includes fastener means 30 for fastening the door stop 2 at an elevated position above a bottom part of the door 12. As best appreciated from FIGS. 7 and 8, the fastener means 30 is a removable fastener means 30. The removable fastener means 30 comprises a hook formation 32 for removably hooking over an upper hinge 34 connecting the door 12 to the door frame 16. The hook formation 32 may have a friction gripping portion 36, and an attachment portion 38 for attaching to the hanger part 4. As can best be appreciated from FIG. 8, the friction-gripping portion 36 is formed by a lower curved part of the hook formation 32. The attachment portion 38 is formed by a bent over part of the fastener means 30 forming two legs 40, 42. These legs 40, 42 are able to be pulled open to allow the hanger part 4 to slide between the legs 40, 42 as shown in FIG. 8.

The door stop 2 is such that the first door-stopping size stops the door 12 in the first open position such that the first open angle is from 60-70°, and preferably 50°. The second door-stopping size stops the door 12 in the second open position such that the second open angle is from 20-30°, and preferably 25°.

As shown in FIG. 7, the door stop part 6 is of a length which is approximately half the total length of the door stop 2. Generally, the door stop part 6 is approximately equal to or more than the length of the hanger part 4. Preferably, the door stop part 6 is 240 mm long, and the hanger part 4 is also 240 mm long. Thus the total length of the door stop 2, excluding the fastener means 30, is 480 mm as shown in FIG. 7.

Figure 10:
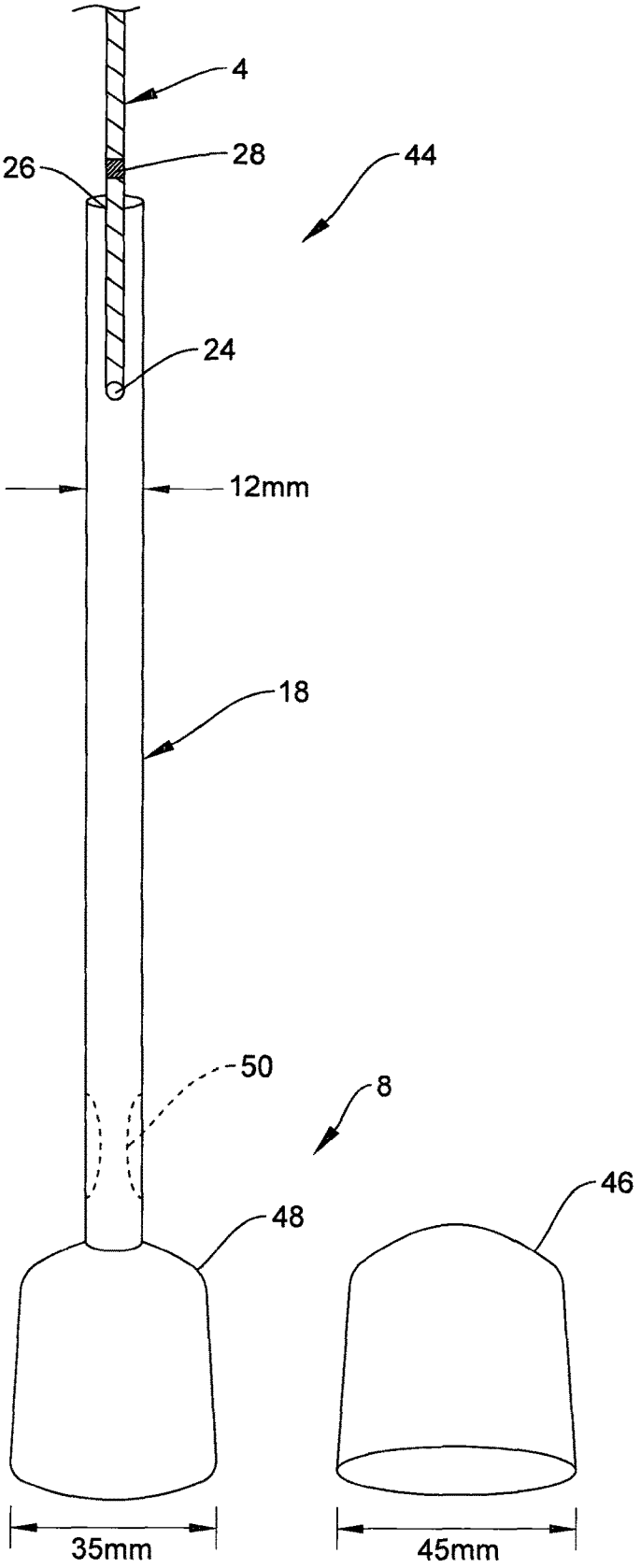
FIG. 10 shows part of a second door stop formation of the present invention.

Referring now to FIG. 10, there is shown part of a second door stop 44 of the present invention. Similar parts as in the door stop 2 have been given the same reference numerals for ease of comparison and understanding.

As shown in FIG. 10, the first door stop formation 8 is a two-piece first door stop formation 8. The two-piece first door stop formation 8 comprises an outer piece 46 and an inner piece 48. The outer piece 46 is a sliding fit over the inner piece 48. The outer piece 46 and the inner piece 48 enable the door stop 44 to be used with doors of different thicknesses. Depending upon the thickness of the door, the door stop 44 can be used just with the inner piece 48, or it can be used with the outer piece 46 fitted over the inner piece 48. The two-piece construction for the first door formation 8 may be advantageous if the door stop 44 is to be sold for use with fire doors and also with non-fire doors, since fire doors are typically thicker than non-fire doors.

FIG. 10 also illustrates how different designs of door stops for the present invention may optionally be such that the second door stop formation 18 is provided with a finger-gripping recess 50. The finger-gripping recess 50 is advantageous for use by adults when they may be gripping the second door stop formation 18 with a view to removing the door stop 2 from the gap 14 and allowing the door 12 to close to the position shown in FIGS. 3 and 6. When gripping the second door stop formation 18, there might be a possibility that the adult might get their fingers trapped between the second door stop formation 18 and the door 12 and/or the door frame 16. The finger-gripping recess 50 helps to avoid this possibility. More specifically, the adult's fingers will be in the finger-gripping recess 50, and the adult will thus be less likely to get their fingers trapped between the second door stop formation 18 and the door 12 and/or the door frame 16.

It is to be appreciated that the embodiments of the invention described above with reference to the accompanying drawings have been given by way of example only and that modifications may be effected. Thus, for example, other constructions may be employed for the hanger part 4 and the door stop part 6. The operational centre of gravity of the door stop 2 may be varied by making the centre of gravity higher than would occur in the door stop 2 shown in the drawings. This may be effected by removing inner material from the first door stop formation 8 and/or putting a weight in the top of the second door stop formation 18. Still further, the length of the first and second door stop formations 8, 18 may be varied. Varying the length of the second door stop formation 18 may vary the position at which the second door stop formation 18 crosses the edge of the door 12 in use of the door stop 2 when the second door stop formation 18 is in the gap 14 at the hinge side 10 of the door 12. The top portion of the second door stop formation 18 may be parallel-sided, or it may taper towards the top, or it may taper away from the top. Still further, the top may be a concave top. The first door stop formation 8 may taper outwardly as shown, or it may taper inwardly or it may be parallel sided. The hanger part 4 is preferably a cord but it may be made of another type of flexible material. The knot 28 may alternatively be a crimp. Individual components shown in the drawings are not limited to use in their drawings and they may be used in other drawings and in all aspects of the invention.

The invention claimed is:

1. A door stop which comprises:

(i) a hanger part; and (ii) a door stop part which in use hangs from the hanger part, the door stop part being such that it comprises:

(iii) a first door stop formation for being positioned at a hinge side of a door, and in a gap between the door and a door frame for the door; and (iv) a second door stop formation for being positioned at the hinge side of the door, and in the gap between the door and the door frame for the door, and wherein:

(v) the first door stop formation is below the second door stop formation when the door stop part hangs from the hanger part;

(vi) the first door stop formation is of a first door-stopping size which stops the door in a first open position at a first open angle;

(vii) the second door stop formation is of a second door-stopping size which stops the door in a second open position at a second open angle;

(viii) the first open angle is larger than the second open angle;

(ix) the first open position is for use by an adult;

(x) the second open position is for use by a child;

(xi) the first open position is such as to cause the gap to be of a first size;

(xii) the second open position is such as to cause the gap to be of a second size;

(xiii) the gap of the first size and the gap of the second size are both such that the child cannot get their fingers trapped firstly between the door and the door frame at the hinge side of the door, and secondly between the door and the door frame at a handle side of the door;

(xiv) the first door stop formation is axially in line with the second door stop formation such that the door stop part has a single straight longitudinal axis;

(xv) the hanger part is such that it comprises a length of flexible material by which the first door stop formation or the second door stop formation are able to be positioned at the hinge side of the door and in the gap between the door and the door frame to give the required first open position or the second open position; and (xvi) the length of flexible material is symmetrically connected to the second door stop formation such that the door stop part is able to hang freely from the length of flexible material with the single straight longitudinal axis of the door stop part being in line with the length of flexible material.

2. A door stop according to claim 1 in which the second door stop formation is longer than the first door stop formation.

3. A door stop according to claim 2 in which the second door stop formation is a rod which is cylindrical in cross section.

4. A door stop according to claim 1 in which the first door stop formation has a curved outer face.

5. A door stop according to claim 1 in which the first door stop formation tapers outwardly in a direction away from the second door stop formation.

6. A door stop according to claim 1 in which the first door stop formation is a one-piece first door stop formation.

7. A door stop according to claim 1 in which the first door stop formation is a two-piece first door stop formation, and in which the two-piece first door stop formation comprises an outer piece which fits over an inner piece.

8. A door stop according to claim 7 in which the outer piece is a sliding fit over the inner piece.

9. A door stop according to claim 1 in which the first door stop formation has a friction-increasing outer surface.

10. A door stop according to claim 9 in which the friction-increasing outer surface is a plurality of longitudinal extending splines.

11. A door stop according to claim 1 in which the second door stop formation includes a finger-gripping recess, and in which the finger-gripping recess prevents the adult from getting their fingers trapped between the second door stop formation and the door and/or the door frame.

12. A door stop according to claim 1 in which the second door stop formation has an end which is remote from the first door stop formation and which is curved.

13. A door stop according to claim 1 in which the hanger part is separate from the door stop part, and in which the hanger part is connected to the door stop part by connecting means.

14. A door stop according to claim 1 and including fastener means for fastening the door stop at an elevated position above a bottom part of the door.

15. A door stop according to claim 14 in which the fastener means is a removable fastener means, and in which the removable fastener means comprises a hook formation for removably hooking over an upper hinge connecting the door to the door frame.

16. A door stop according to claim 1 in which the first door-stopping size stops the door in the first open position such that the first open angle is from 60-80°.

17. A door stop according to claim 1 in which the second door-stopping size stops the door in the second open position such that the second open angle is from 20-30°.

18. A door stop according to claim 1 in which the door stop part is of a length which is approximately half the total length of the door stop.

19. A door stop according to claim 1 in which the door stop part is 24 cm long, and in which the door stop is 50 55 cm long.

* * * * *